US011780723B2

(12) United States Patent
Yamashita

(10) Patent No.: US 11,780,723 B2
(45) Date of Patent: Oct. 10, 2023

(54) MANAGEMENT APPARATUS

(71) Applicants: ASAHI GROUP HOLDINGS, LTD., Tokyo (JP); ASAHI BREWERIES, LTD., Tokyo (JP)

(72) Inventor: Naoyuki Yamashita, Moriya (JP)

(73) Assignees: ASAHI GROUP HOLDINGS, LTD., Tokyo (JP); ASAHI BREWERIES, LTD., Tokyo (JP)

( * ) Notice: Subject to any disclaimer, the term of this patent is extended or adjusted under 35 U.S.C. 154(b) by 0 days.

(21) Appl. No.: 17/827,003

(22) Filed: May 27, 2022

(65) Prior Publication Data

US 2022/0289552 A1 Sep. 15, 2022

Related U.S. Application Data

(63) Continuation of application No. PCT/JP2021/009594, filed on Mar. 10, 2021.

(30) Foreign Application Priority Data

Mar. 27, 2020 (JP) ..... 2020-058274

(51) Int. Cl.
*B67D 1/12* (2006.01)

(52) U.S. Cl.
CPC ..... *B67D 1/1245* (2013.01)

(58) Field of Classification Search
CPC .. B67D 1/1245; B67D 1/0406; B67D 1/1252; B67D 1/0857; B67D 1/0884; B67D 1/0888; B67D 1/1247; B67D 1/0004; B67D 2210/00091
See application file for complete search history.

(56) References Cited

U.S. PATENT DOCUMENTS

| | | | | |
|---|---|---|---|---|
| 8,387,826 | B2 | 3/2013 | Tsubouchi et al. | |
| 11,332,357 | B2 | 5/2022 | Yamashita et al. | |
| 2009/0194564 | A1 | 8/2009 | Tsubouchi et al. | |
| 2017/0144877 | A1* | 5/2017 | Rider | B67D 1/0412 |
| 2017/0240403 | A1* | 8/2017 | An | B67D 1/0884 |
| 2019/0210859 | A1* | 7/2019 | Lambrecht | B67D 1/0418 |
| 2020/0391990 | A1 | 12/2020 | Yamashita et al. | |

(Continued)

FOREIGN PATENT DOCUMENTS

| | | | |
|---|---|---|---|
| DE | 1099294 | B | 2/1961 |
| EP | 3584215 | A1 | 12/2019 |
| GB | 1504986 | A | 3/1978 |

(Continued)

OTHER PUBLICATIONS

International Search Report for PCT/JP2021/009594 dated Apr. 6, 2021 (partially translated).

(Continued)

*Primary Examiner* — Donnell A Long
(74) *Attorney, Agent, or Firm* — Thomas | Horstemeyer LLP

(57) ABSTRACT

A management apparatus MA includes a pressure sensor 12 configured to detect a pressure of a gas cylinder 110 that supplies carbon dioxide gas to a beverage barrel 120 so as to supply the beverage from the beverage barrel 120 to the beverage server 150, and a control unit 20 configured to notify exchange of the gas cylinder 110 based on an output from the pressure sensor 12.

7 Claims, 4 Drawing Sheets

(56) References Cited

U.S. PATENT DOCUMENTS

2022/0162052 A1* 5/2022 Rider ..... B67D 1/0889

FOREIGN PATENT DOCUMENTS

| | | | |
|---|---|---|---|
| GB | 2415952 | A | 1/2006 |
| JP | H10-273053 | A | 10/1998 |
| JP | 2003-054696 | A | 2/2003 |
| JP | 2007-182250 | A | 7/2007 |
| JP | 2010-173664 | A | 8/2010 |
| JP | 2018-103999 | A | 7/2018 |
| JP | 2018-193077 | A | 12/2018 |
| JP | 2019-104504 | A | 6/2019 |
| JP | 2020-132197 | A | 8/2020 |
| JP | 6887869 | B2 | 6/2021 |
| WO | 2008/010454 | A1 | 1/2008 |
| WO | 2019/116822 | A1 | 6/2019 |
| WO | 2021/193068 | A1 | 9/2021 |

OTHER PUBLICATIONS

Notice of Submission of Publications for Japanese Patent Application No. 2020-058274 dated May 19, 2023 (partially translated).
Extended European Search Report for PCT/JP2021/009594 dated Aug. 11, 2023.

* cited by examiner

MANAGEMENT APPARATUS

CROSS-REFERENCE TO RELATED APPLICATION(S)

This application is a continuation of International Patent Application No. PCT/JP2021/009594 filed on Mar. 10, 2021, which claims priority to and the benefit of Japanese Patent Application No. 2020-058274 filed on Mar. 27, 2020, the entire disclosures of which are incorporated herein by reference.

TECHNICAL FIELD

The present invention relates to a management apparatus.

BACKGROUND ART

There is available a beverage server system for dispensing a beverage in a beverage barrel by using the pressure of carbon dioxide gas. In such a beverage server system, the carbon dioxide gas is supplied from a gas cylinder to a dispensing head mounted on the mouth of a beverage barrel to inject the beverage in the beverage barrel via the dispensing head, thereby supplying the beverage to the beverage server. The beverage server cools the supplied beverage and dispenses the beverage to a beverage providing container via a dispensing cock.

PTL 1 discloses a carbon dioxide gas pressure regulator for controlling the supply pressure of the carbon dioxide gas in accordance with a temperature. The carbon dioxide gas pressure regulator is arranged to control the supply pressure of the carbon dioxide gas in accordance with a control map defining the relationship between the temperature and the supply pressure of the carbon dioxide gas. The control map includes a normal mode control map and a closed mode control map. The normal mode control map defines the relationship between the temperature and the supply pressure such that a predetermined supply pressure P2 is set at a temperature equal to or less than a predetermined temperature T1, a predetermined supply pressure P4 is set at a temperature equal to or more than a predetermined temperature T2, the temperature increases in the range from the temperature T1 to the temperature T2, and the supply pressure monotonically increases from the supply pressure P2 to the supply pressure P4. The closed mode control map defines the relationship between the temperature and the supply pressure such that the predetermined supply pressure P1 is set regardless of the change in temperature, and the supply pressure P1 is lower than the supply pressure P2 by 0.01 MPa to 0.10 MPa.

CITATION LIST

Patent Literature

PTL 1: Japanese Patent Laid-Open No. 2010-173664

SUMMARY OF INVENTION

Technical Problem

There is not conventionally provided a function of detecting the remaining amount of the carbon dioxide gas in the gas cylinder or prompting the exchange of the gas cylinder based on the detection result. If the remaining amount of the carbon dioxide gas in the gas cylinder lowers, the carbon dioxide gas cannot be supplied to the beverage barrel at a set pressure. Accordingly, if the remaining amount of the carbon dioxide gas in the gas cylinder lowers, the beverage cannot be supplied to the beverage server at an optimal pressure, and finally the dispensing disable state is set. For this reason, the quality (for example, a carbon dioxide gas amount or bubbles) of the beverage to be dispensed to the beverage providing container lowers. In addition, when the dispensing disable state of the beverage suddenly occurs in a time zone where the orders are concentrated, the customer satisfaction may lower or the sales opportunities may be lost.

The present invention has an object to provide a technique advantageous in prompting the exchange of the gas cylinder.

Solution to Problem

An aspect of the present invention relates to a management apparatus, and the management apparatus comprises a pressure sensor configured to detect a pressure of a gas cylinder that supplies carbon dioxide gas to a beverage barrel so as to supply the beverage from the beverage barrel to the beverage server, and a control unit configured to notify exchange of the gas cylinder based on an output from the pressure sensor.

Advantageous Effects of Invention

The present invention provides a technique advantageous in prompting exchange of the gas cylinder.

DESCRIPTION OF EMBODIMENTS

Figure 1:
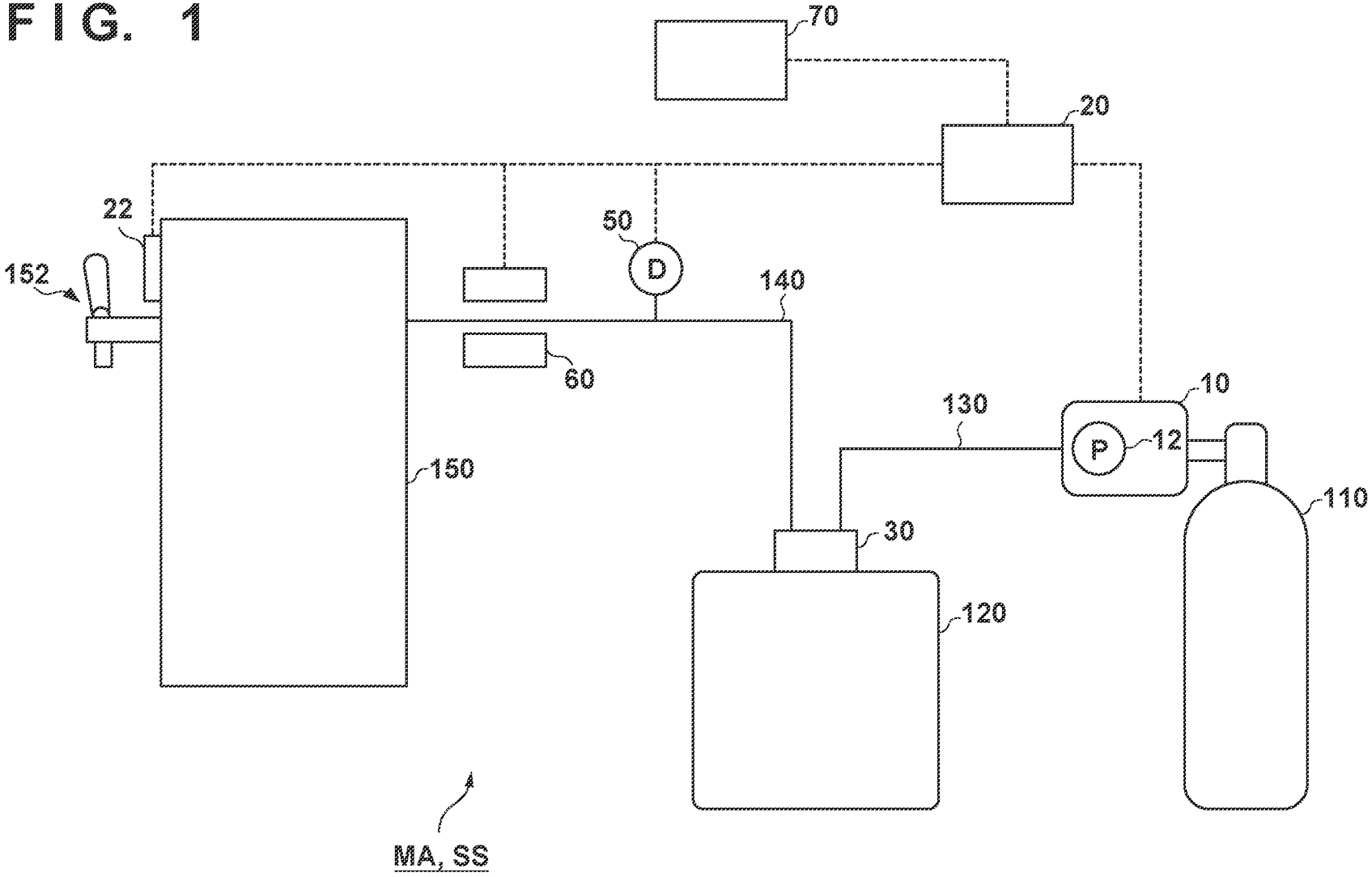
FIG. 1 is a view showing the arrangement of a beverage dispensing system incorporating a management apparatus according to an embodiment.

Hereinafter, embodiments will be described in detail with reference to the attached drawings. Note, the following embodiments are not intended to limit the scope of the claimed invention, and limitation is not made to an invention that requires a combination of all features described in the embodiments. Two or more of the multiple features described in the embodiments may be combined as appropriate. Furthermore, the same reference numerals are given to the same or similar configurations, and redundant description thereof is omitted.

FIG. 1 exemplifies the arrangement of a beverage dispensing system SS incorporating a management apparatus MA according to an embodiment. The beverage dispensing system SS can include a dispensing head 30 mounted on the mouth of a beverage barrel 120 filled with a beverage (for example, beer or a beer-based beverage such as low-malt beer) and a beverage server 150 that cools the beverage supplied from the beverage barrel 120 via the dispensing head 30 and dispenses the cooled beverage to the beverage providing container via a dispensing cock 152. A gas cylinder 110 supplies the carbon dioxide gas to the beverage barrel 120 via the dispensing head 30 so as to supply the beverage from the beverage barrel 120 to the beverage server 150. A regulator 10 is mounted on the gas cylinder 110 to decrease the pressure of the carbon dioxide gas supplied from the gas cylinder 110 to a set pressure and sending out the carbon dioxide gas to a secondary side.

The dispensing head 30 receives, via the regulator 10 and a gas supply path 130, the carbon dioxide gas from the gas cylinder 110 storing the carbon dioxide gas. The carbon dioxide gas is supplied to the internal space of the beverage barrel 120. When a pressure is applied to the liquid surface of the beverage, the beverage is injected from the dispensing head 30. The beverage is supplied to the beverage server 150 via a channel 140.

The management apparatus MA can include a pressure sensor 12 for detecting the pressure of the gas cylinder 110 and a control unit 20 for notifying the exchange of the gas cylinder 110 based on an output from the pressure sensor 12. The management apparatus MA can further include the regulator 10. The control unit 20 can be arranged to prompt the exchange of the gas cylinder 110 based on the set pressure of the regulator 10 in addition to the output from the pressure sensor 12. As an example, the control unit 20 can include a CPU and a memory for providing a program to the CPU. As an example, the pressure sensor 12 can be incorporated in the regulator 10.

The control unit 20 is arranged to calculate, based on the output from the pressure sensor 12, the number of beverage barrels 120 capable of dispensing the beverage using the carbon dioxide gas from the gas cylinder 110 and notify information corresponding to the number of beverage barrels. If the number of beverage barrels 120 capable of injecting the barrage is equal to or less than a predetermined count, the control unit 20 may be arranged to notify this. If the number of beverage barrels 120 is equal to or less than the predetermined count, the control unit 20 notifies a case by distinguishing it from a case in which the number of beverage barrels 120 is larger than the predetermined count. For example, if the number of beverage barrels 120 capable of dispensing the beverage is larger than the predetermined count, a notification is performed at the first level. If the number of beverage barrels 120 capable of dispensing the beverage is equal to or less than the predetermined count, the notification can be performed at the second level which has a stronger stimulus than that of the first level for the operator. If the notification includes a notification using a sound, the notification of the second level can be a notification using a larger sound than that of the notification of the first level. If the notification includes a notification using light or display, the notification of the first level is, for example, a notification not accompanying flickering. The notification of the second level can be, for example, a notification accompanying flickering.

The management apparatus MA may further include a beverage sensor 50 and a blocking unit 60. The beverage sensor 50 is arranged in the channel 140 of the beverage between the beverage barrel 120 and the beverage server 150 and detects the beverage. For example, the beverage sensor 50 can include a light-emitting element whose optical axis is arranged across the channel 140 and a light-receiving element for receiving light from the light-emitting element via the channel 140. As an example, the light-emitting element and the light-receiving element are arranged outside a tube which forms the channel 140. The tube can have a window through which light from the light-emitting element passes. Alternatively, the tube may be arranged by a light-transmitting tube. The beverage sensor 50 can be arranged by various kinds of sensors in addition to the light-transmitting tube.

The blocking unit 60 can be arranged to block the channel 140. For example, the blocking unit 60 can be arranged to block the channel 140 by suppressing the tube forming the channel 140 and reducing the sectional area of the channel 140. For example, the blocking unit 60 can be a fluid stopper device shown in FIGS. 6C and 6D of Japanese Patent Laid-Open No. 2019-104504.

If the number of beverage barrels 120 capable of dispensing the beverage is one or less and the exchange of the beverage barrel 120 is detected based on the output from the beverage sensor 50, the control unit 20 may be arranged to determine whether the gas cylinder 110 was exchanged. In addition, if the gas cylinder 110 was not exchanged, the control unit 20 may control the blocking unit 60 to block the channel 140. This is effective to suppress dispensing of the beverage having poor quality by forcibly exchanging the gas cylinder 110.

The control unit 20 may include a notification unit 22 attached to the beverage server 150. If the exchange of the gas cylinder is to be prompted based on the output from the pressure sensor 12, the control unit 20 may control the notification unit 22 so as to perform a notification for prompting the exchange of the gas cylinder. At the time of dispensing the beverage, the control unit 20 may control the notification unit 22 to emphasize the notification for prompting the exchange of the gas cylinder 110. In this case, the management apparatus MA may further include a dispensing detection unit (not shown) for detecting the dispensing of the beverage by the beverage server 150. The dispensing detection unit can include a sensor for detecting, for example, an operation of the dispensing cock 152 and can detect the dispensing of the beverage based on the output from this sensor. Alternatively, the dispensing detection unit can detect the sound or vibration generated by the beverage flowing through the beverage supply path arranged in the beverage server 150 and detect the beverage based on the sound or vibration.

The control unit 20 can recognize the dispensing of the beverage based on the output from the dispensing detection unit. If the exchange of the gas cylinder 110 is to be prompted based on the output from the pressure sensor 12 and the beverage dispensing state is set, the control unit 20 controls the notification unit 22 so as to emphasize the notification for prompting the exchange of the gas cylinder 110. If (a) the exchange of the gas cylinder 110 is to be prompted based on the output from the pressure sensor 12 and the state in which the beverage is not disposed is set, the control unit 20 performs the notification at the first level. If (b) the exchange of the gas cylinder 110 is to be prompted based on the output from the pressure sensor 12 and the beverage dispensing state is set, the control unit 20 can perform the notification at the second level which has a stronger stimulus than the first level for the operator. If the notification includes a notification using a sound, the notification at the second level can be, for example, a notification using a larger sound than that of the first level. If the notification includes a notification using light or display, the notification at the first level can be, for example, a notification not accompanying flickering. The notification at the second level can be, for example, a notification accompanying flickering.

The control unit 20 may be arranged to transmit, to an information collection device 70, the output from the pressure sensor 12 or information obtained by processing the output from the pressure sensor 12. The information collection device 70 can be arranged in a supervising unit for supervising, for example, a plurality of stores. The information collection device 70 is connected to the control unit 20 of the management apparatus MA of each store and can manage the state of the gas cylinder 110 based on the output of the pressure sensor 12 or information obtained by processing this output, which is provided from the control unit 20. This management can include, for example, a case in which the information for prompting the exchange of the gas cylinder 110 is provided to the store, a case in which the delivery of the gas cylinder 110 to the store is arranged, or a case in which a timing at which the gas cylinder 110 has been exchanged is statistically processed.

Figure 2:
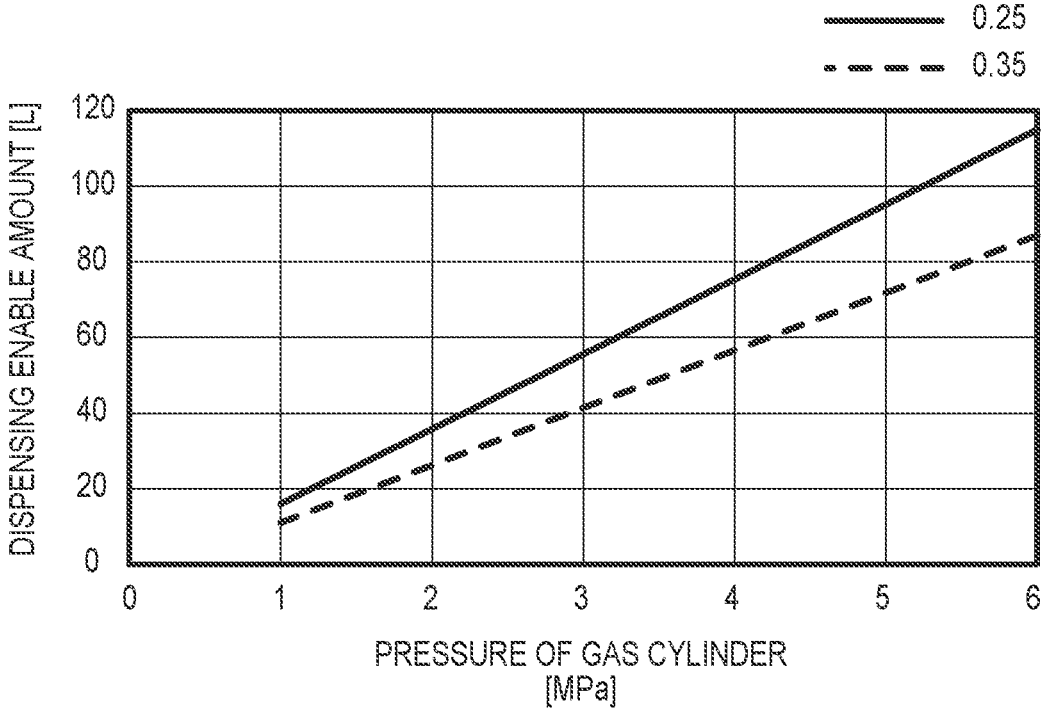
FIG. 2 is a graph exemplifying a relationship between the pressure of a gas cylinder and the dispensing enable amount of the beverage.

FIG. 2 exemplifies the relationship between the pressure of the gas cylinder 110 and the dispensing enable amount of the beverage. The abscissa represents the pressure of the gas cylinder 110, which is a pressure detectable by the pressure sensor 12. The ordinate represents a dispensing enable beverage amount (extraction enable amount) by the carbon dioxide gas left in the gas cylinder 110. A solid line represents the relationship between the pressure of the gas cylinder 110 and the dispensing enable amount of the beverage when the set pressure (the pressure on the secondary side, that is, the pressure on the output side of the regulator 10) of the regulator 10 is 0.25 [Mpa]. A dotted line represents the relationship between the pressure of the gas cylinder 110 and the dispensing enable amount of the beverage when the set pressure (the pressure on the secondary side, that is, the pressure on the output side of the regulator 10) of the regulator 10 is 0.35 [Mpa].

As shown in FIG. 2, the pressure of the gas cylinder 110 is kept unchanged, the dispensing enable amount is smaller as the set pressure of the regulator 10 is higher. As described above, the control unit 20 is arranged to prompt the exchange of the gas cylinder 110 based on the set pressure of the regulator 10 in addition to the output from the pressure sensor 12. More specifically, the control unit 20 is arranged to detect the arrival of the state of prompting the exchange of the gas cylinder 110 based on a function using the output (pressure) of the pressure sensor 12 and the set pressure of the regulator 10 as a variable or based on a lookup table or the like and prompt the exchange of the gas cylinder 110 in accordance with this detection.

The beverage barrel 120 can have various capacities. The number of beverage barrels 120 capable of dispensing the beverage in accordance with the remaining amount of the carbon dioxide gas in the gas cylinder 110 depends on the capacity of the beverage barrel 120. Accordingly, in accordance with the capacity of the beverage barrel 120, the control unit 20 or the notification unit 22 may notify the number of beverage barrels 120 capable of dispensing the beverage depending on the remaining amount of the carbon dioxide gas in the gas cylinder 110.

Based on the relationship shown in FIG. 2 and the capacity of the beverage barrel 120, the control unit 20 can calculate the number of beverage barrels 120 capable of dispensing the beverage by the carbon dioxide gas (the remaining amount of the carbon dioxide gas in the gas cylinder 110) from the gas cylinder 110.

For example, if the set pressure of the regulator 10 is 0.35 [Mpa] and the pressure of the gas cylinder 110 which is detected by the pressure sensor 12 is 1 [Mpa], the dispensing enable amount is 11 [L]. If a beverage barrel having a capacity of 10 [L] and a beverage barrel having a capacity of 19 [L] can be used as the beverage barrels 120, the control unit 20 can calculate that the number of beverage barrels each having the capacity of 10 [L] is one and the number of beverage barrels each having the capacity of 19 [L] is 0.5. The control unit 20 can notify this result.

As another example, if the set pressure of the regulator 10 is 0.35 [Mpa] and the pressure of the gas cylinder 110 which is detected by the pressure sensor 12 is 1.56 [Mpa], the dispensing enable amount is 20 [L]. If a beverage barrel having a capacity of 10 [L] and a beverage barrel having a capacity of 19 [L] can be used as the beverage barrels 120, the control unit 20 can calculate that the number of beverage barrels each having the capacity of 10 [L] is two and the number of beverage barrels each having the capacity of 19 [L] is one. The control unit 20 can notify this result.

Figure 3:
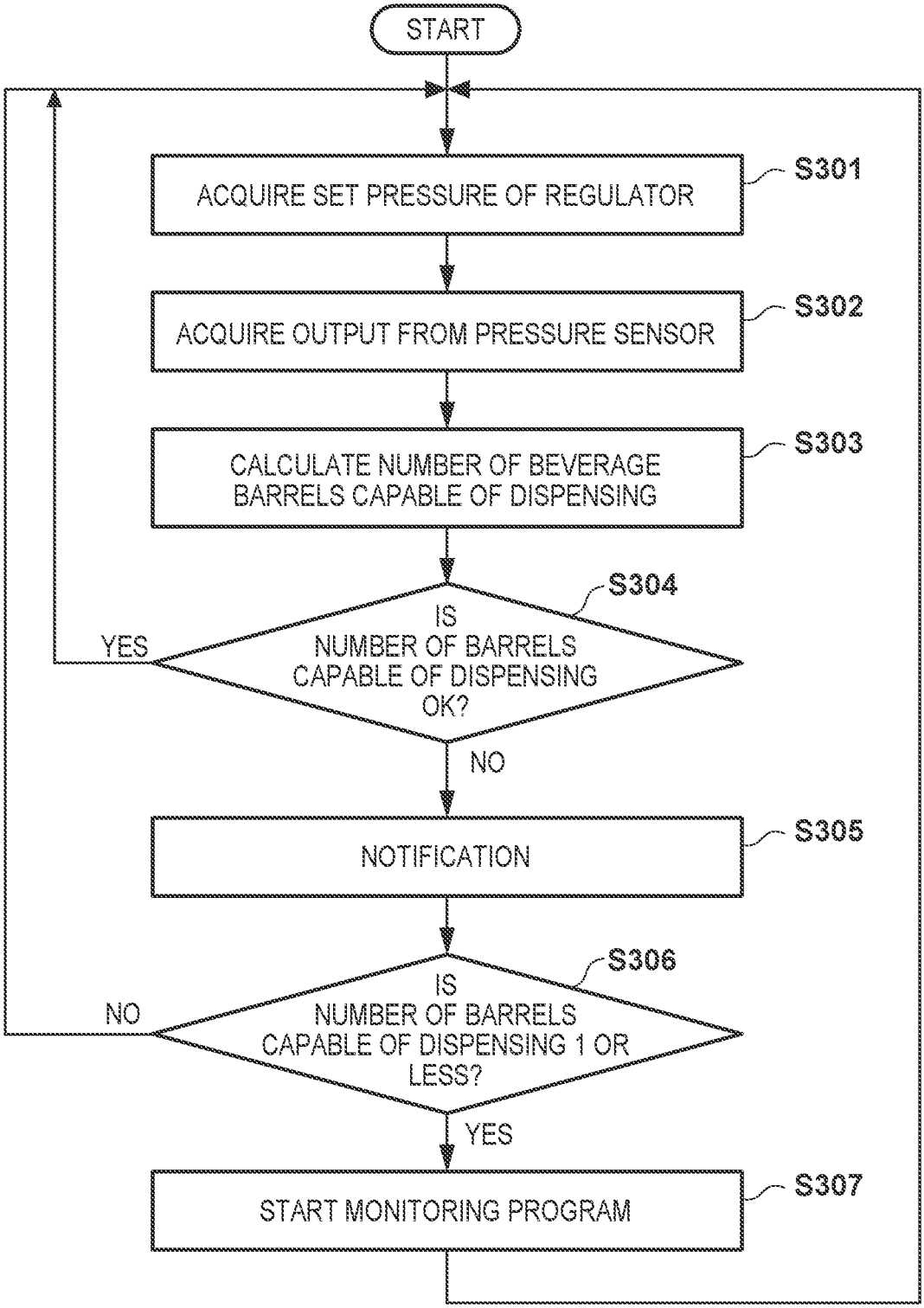
FIG. 3 is a flowchart exemplifying an operation of a control unit.

FIG. 3 exemplifies the operation of the control unit 20. In step S301, the control unit 20 acquires information indicating the set pressure of the regulator 10. In step S302, the control unit 20 acquires the output (pressure) of the pressure sensor 12. In this case, the output from the pressure sensor 12 may be information indicating the pressure of the gas cylinder 110 on a predetermined unit (for example, MPa) or information having correlation with the pressure of the gas cylinder 110 (for example, information indicating the value proportional to the pressure or the degree to which the current pressure among a plurality of grades belongs).

In step S303, the control unit 20 calculates the number of beverage barrels 120 capable of dispensing the beverage based on the relationship exemplified in FIG. 2, the set pressure of the regulator 10, and the output (pressure) of the pressure sensor 12. If the beverage barrel 120 can have various capacities, as described in the above examples, the control unit 20 can calculate the number of beverage barrels capable of dispensing the beverage for each capacity. Alternatively, in an arrangement in which the capacity of the beverage barrel 120 can be set by a user or the like, the control unit 20 may calculate the number of beverage barrels capable of dispensing the beverage based on the set capacity.

In step S304, the control unit 20 determines whether the number of beverage barrels 120 capable of dispensing the beverage is equal to or less than a predetermined count (for example, 1, 2, 3, or the like). If the number of beverage barrels capable of dispensing the beverage is equal to or less than the predetermined count, the control unit 20 performs a notification in step S305. This notification can be performed via the notification unit 22. The main body forming the control unit 20 and the notification unit 22 may be arranged to be accommodated in separate housings or may be arranged to be accommodated in the same housing. If the main body forming the control unit 20 and the notification unit 22 are accommodated in the separate housings, the main body and the notification unit 22 are connected by a wired or wireless connection. In step S304, if the number of beverage barrels 120 capable of dispensing the beverage is larger than the predetermined count, the process by the control unit 20 returns to step S301.

In step S306, the control unit 20 determines whether the number of beverage barrels 120 capable of dispensing the beverage is equal to or less than one. If the number of beverage barrels 120 capable of dispensing the beverage is equal to or less than one (for example, if the calculation value of the number of beverage barrels capable of dispensing the beverage is equal to or less than 1.0), a monitor program is started in step S307. In step S306, if the number of beverage barrels 120 capable of dispensing the beverage is larger than one (for example, if the calculation value of the number of beverage barrels capable of dispensing the beverage is larger than 1.0), the process of the control unit 20 returns to step S301.

Figure 4:
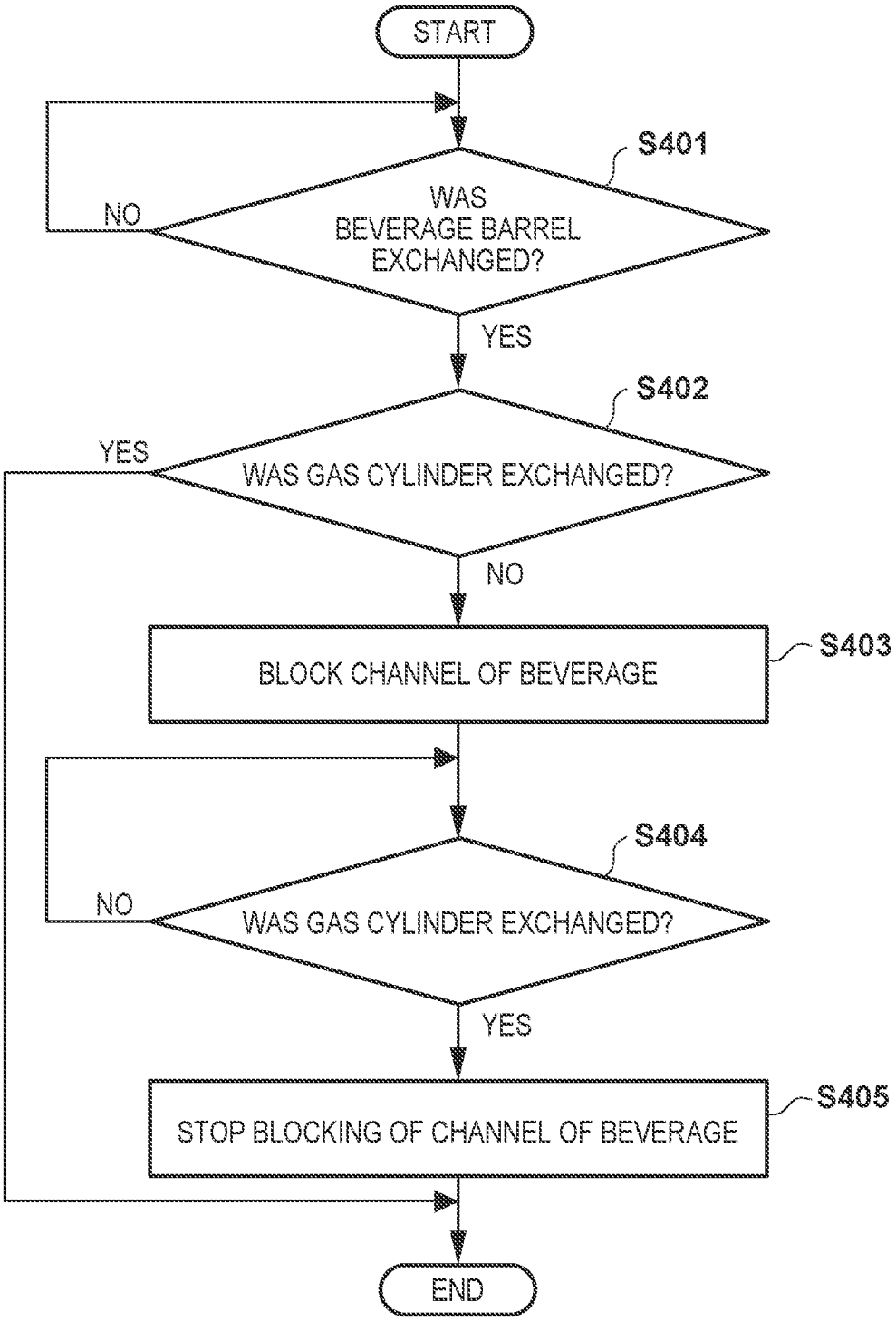
FIG. 4 is a flowchart exemplifying an operation of a monitor program.

FIG. 4 exemplifies the operation of the monitor program started in step S307 of FIG. 3. In step S401, the control unit 20 determines whether the beverage barrel 120 was exchanged. This determination can be performed based on the output from the beverage sensor 50. More specifically, if the output from the beverage sensor 50 indicates that a state in which the beverage is detected transitions to a state in which the beverage is not detected, and then the state is further changed to a state in which the beverage is detected, the control unit 20 determines that the beverage barrel 120 was exchanged. Alternatively, if a user interface (not shown) is arranged in the control unit 20 or the like and the exchange of the beverage barrel 120 is input to the user interface by the user, the control unit 20 can determine that the beverage barrel 120 was exchanged.

In step S401, if it is determined that the beverage barrel 120 was exchanged, step S402 is executed. In step S402, the control unit 20 determines whether the gas cylinder 110 was exchanged. This determination is performed based on, for example, the output from the pressure sensor 12. More specifically, if the output from the pressure sensor 12 exceeds a reference value, the control unit 20 determines that the gas cylinder 110 was exchanged.

In step S402, if it is determined that the gas cylinder 110 was exchanged, the monitor program ends. On the other hand, in step S402, if it is not determined that the gas cylinder 110 was exchanged, that is, if it is not determined that the gas cylinder 110 was exchanged upon the exchange of the beverage barrel 120, the control unit 20 can control the blocking unit 60 so as to block the channel 140. This forcibly exchanges the gas cylinder 110 if the number of beverage barrels 120 capable of dispensing the beverage is equal to or less than one and the gas cylinder 110 was not exchanged although the exchange of the beverage barrel 120 is detected. This is effective to suppress dispensing of the beverage having poor quality.

In step S404, the control unit 20 determines whether the gas cylinder 110 was exchanged. This determination can be performed based on, for example, the output from the pressure sensor 12. In step S404, it is determined that the gas cylinder 110 was exchanged, the control unit 20 controls the blocking unit 60 to stop blocking of the channel 140 in step S405. The monitor program then ends.

The invention is not limited to the foregoing embodiments, and various variations/changes are possible within the spirit of the invention.

The invention claimed is:

1. A management apparatus comprising:

a pressure sensor configured to detect a pressure of a gas cylinder that supplies carbon dioxide gas to a beverage barrel so as to supply the beverage from the beverage barrel to a beverage server; and a control unit configured to notify exchange of the gas cylinder based on an output from the pressure sensor, wherein the control unit calculates, based on the output from the pressure sensor, the number of beverage barrels capable of dispensing the beverage by the carbon dioxide gas from the gas cylinder and performs a notification in accordance with the number of beverage barrels capable of dispensing the beverage.

2. The management apparatus according to claim 1, further comprising a regulator configured to lower a pressure of the carbon dioxide gas supplied from the gas cylinder to a set pressure, wherein the control unit prompts exchange of the gas cylinder based on the set pressure in addition to an output from the pressure sensor.

3. The management apparatus according to claim 1, wherein if the number of beverage barrels capable of dispensing the beverage is not more than a predetermined count, the control unit notifies it.

4. The management apparatus according to claim 1, wherein if the number of beverage barrels capable of dispensing the beverage is not more than a predetermined count, the control unit notifies a case in which the number of beverage barrels capable of dispensing the beverage is not more than the predetermined count by distinguishing it from a case in which the number of beverage barrels is larger than the predetermined count.

5. The management apparatus according to claim 1, further comprising:

a beverage sensor arranged in a channel of the beverage between the beverage barrel and the beverage server and configured to detect the beverage; and a blocking unit configured to block the channel, wherein if the number of beverage barrels capable of dispensing the barrel is not more than one and exchange of the beverage barrel is detected based on the output from the beverage sensor, the control unit determines whether the gas cylinder was exchanged, and if the gas cylinder was not exchanged, the control unit controls the blocking unit so as to block the channel.

6. The management apparatus according to claim 1, wherein the control unit includes a notification unit attached to the beverage server, and if exchange of the gas cylinder is to be prompted, the control unit controls the notification unit so as to perform a notification for prompting exchange of the gas cylinder.

7. The management apparatus according to claim 1, wherein the control unit transmits, to an information collection device, information obtained by the output from the pressure sensor or information obtained by processing the output.

* * * * *